United States Patent [19]

Arai et al.

[11] 4,354,756

[45] Oct. 19, 1982

[54] COPYING APPARATUS

[75] Inventors: Yasunori Arai, Hatoyama; Ryota Ogawa, Kawagoe; Michiro Ohishi, Hatoyama, all of Japan

[73] Assignee: Asahi Kogaku Kogyo Kabushiki Kaisha, Tokyo, Japan

[21] Appl. No.: 253,637

[22] Filed: Apr. 13, 1981

[30] Foreign Application Priority Data

Apr. 23, 1980 [JP] Japan ..... 55/53726

[51] Int. Cl.[3] ..... G03G 15/00

[52] U.S. Cl. ..... 355/3 R; 355/5; 355/8; 355/14 R; 355/57

[58] Field of Search ..... 355/3 R, 14 R, 8, 5, 355/11, 51, 50, 66, 57, 60

[56] References Cited

U.S. PATENT DOCUMENTS 4,008,958 2/1977 Kingsland ..... 355/51
4,021,109 5/1977 Tanaka et al. ..... 355/8
4,033,689 7/1977 Washio et al. ..... 355/8
4,129,379 12/1978 Ogrisek et al. ..... 355/57

*Primary Examiner*—A. C. Prescott
*Attorney, Agent, or Firm*—Sughrue, Mion, Zinn, Macpeak & Seas

[57] ABSTRACT

A copying apparatus and method in which a single image of an original is utilized to form plural copies without degradation of the copy quality. A single rotatable drum is provided which has first and second photosensitive surfaces formed thereon. The image of the original is first scanned in response to which a latent image is formed the first photosensitive surface. This image is developed to form a primary toner image. As the drum is rotated through 180°, the primary toner image is repeatedly transferred to the second photosensitive surface so as to form repeatedly, upon developing, secondary toner images which are transferred to recording sheets. The same optical system is utilized for illuminating the first photosensitive surface with an image of the original and for transferring the primary toner image onto the second photosensitive surface.

9 Claims, 2 Drawing Figures

COPYING APPARATUS

BACKGROUND OF THE INVENTION

The present invention relates to a high-speed copying apparatus which is capable of producing a plurality of copies of an original by subjecting the original to exposure scanning only once.

Several methods of producing a plurality of copies of an original using only one electrostatic latent image have been proposed for a copying apparatus of this general type. According to one of the conventional methods, a single electrostatic latent image is repeatedly used to produce a plurality of copies. However, the method is disadvantageous in that, as the number of copies increases, the quality of the reproduced images is degraded. That is, the quality of each reproduced image is lower than that of the preceding image because the surface potential of the photosensitive body gradually decreases with an increasing number of copies after the latent image has been formed. In another method, two photosensitive drums are employed to eliminate the above-described difficulty. Since it is difficult to produce a number of copies at high speed using a method wherein an original is scanned linearly and repeatedly, the image of the original is formed as a toner image on the surface of the first photosensitive drum and the toner image is used as a secondary original. As the secondary original can be scanned by turning the first photosensitive drum, the copying speed can be increased. The image of the secondary original is formed on the second photosensitive drum and is then transferred onto a recording sheet.

An example of a high-speed copying apparatus operating according to this conventional method is shown in FIG. 1. Referring to FIG. 1, as a first stage of the process, an original 1 to be copied is illuminated by an illuminating device 2. Light from the original thus illuminated (optical data) is reflected by a mirror 3, passed through a projecting lens 4, reflected by a mirror 5 and a movable mirror 6-1, and then applied to the surface of a first photosensitive drum 7*a* thus forming the image of the original on the surface of the first photosensitive drum 7*a*. As the first photosensitive drum 7*a* has been previously charged by a charging unit 13*a*, the electrostatic latent image is formed as a result of the formation of the original image. The latent image thus formed is developed into a toner image by a developing device 14*a*. The image of the original 1 is formed as a visible toner image on the surface of the first photosensitive drum 7*a* to provide a secondary original image. In a second stage of the process, the secondary original image is illuminated by an illuminating device 10 disposed near the first photosensitive drum 7*a*. Light from the secondary original image thus illuminated (optical data) is reflected by the aforementioned movable mirror 6-1 whose reflecting surface has been turned counterclockwise through about 90° from its position in the first stage of the process. The light thus reflected passes through a second projecting lens 4*b*, reflected by a mirror 9, and applied to the surface of a second photosensitive drum 7*b* which has been charged by a second charging device 13*b* thus projecting the secondary original image onto the surface of the second photosensitive drum 7*b*. This image is developed by a developing device 14*b*, transferred onto a recording sheet delivered from a copying sheet supplying device 16 by a transferring device 15, and fixed by a fixing device 17.

The implementation of this method requires two photosensitive drums, namely, the first and second photosensitive drums 7*a* and 7*b*, two processing devices such as the discharging devices 11*a* and 11*b*, the charging devices 13*a* and 13*b*, the developing devices 14*a* and 14*b* and cleaning devices 12*a* and 12*b*, and two projecting lenses 4*a* and 4*b*. In addition, there is a requirement for a mechanism for controlling the synchronous operation of the two photosensitive drums. Accordingly, a copying apparatus operating in accordance with this method is considerably expensive due to component and manufacturing costs. In order to project the image formed on the first photosensitive drum 7*a* onto the second photosensitive drum 7*b* using the second projecting lens 4*b*, some space must be provided therebetween which results in a large overall size of the copying apparatus.

Accordingly, an object of the present invention is to eliminate all the drawbacks accompanying a conventional copying apparatus. More specifically, an object of the invention is to provide a copying apparatus which uses only one photosensitive drum to provide a number of copies of high image quality in a short period of time, and which has a low manufacturing cost and small size.

SUMMARY OF THE INVENTION

In accordance with these and other objects of the invention, there is provided a copying apparatus and copying method in which the image of an original is formed with a primary toner image on a first photosensitive surface provided on a single rotatable drum and the primary toner image is repeatedly transferred to a second photosensitive surface provided on the single rotatable drum. The secondary images are repeatedly developed and transferred to recording sheets until the required number of copies has been made. Preferably, a single optical system is used both to transfer the image of the original onto the first photosensitive surface and to transfer the primary toner images formed on the first photosensitive surface repeatedly onto the second photosensitive surface. This optical system preferably includes first through third fixed mirrors, a projecting lens and a movable mirror. In a first position of the movable mirror, light is reflected from the original through the projecting lens and by the first and second mirrors onto a first side of the rotatable drum. In the second position of the movable mirror, the toner image which has been developed on the first photosensitive surface as the drum is rotated through 180° is reflected from a second side of the rotatable drum by the third mirror to the movable mirror and through the projecting lens and the first and second mirrors onto the first side of the photosensitive drum onto the second photosensitive surface which is then adjacent the first side of the drum due to the rotation thereof. As used in this context, "side" refers to a position fixed with respect to the optical system rather than a fixed point upon the surface of the drum.

DESCRIPTION OF THE PREFERRED EMBODIMENTS

Figure 1:
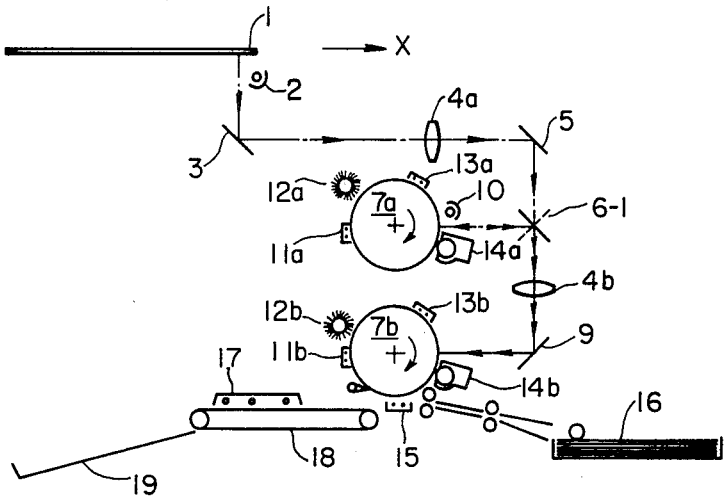
FIG. 1 is an explanatory diagram showing the arrangement of a conventional copying apparatus.
Figure 2:
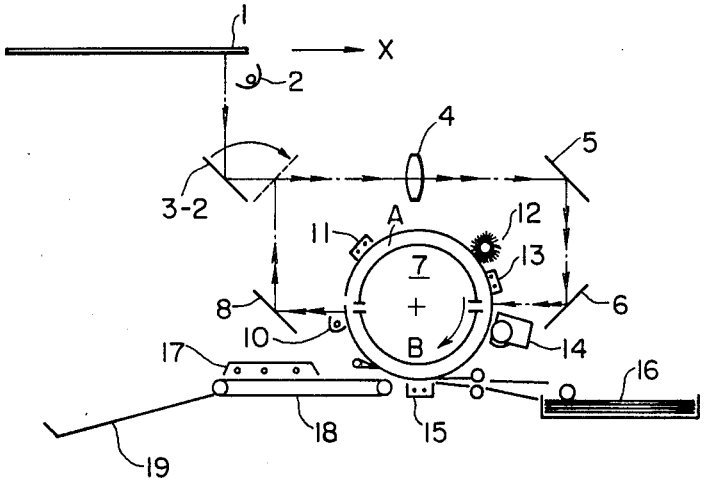
FIG. 2 is an explanatory diagram showing the arrangement of a preferred embodiment of a copying apparatus according to the invention.

The invention will now be described with reference to a preferred embodiment shown in FIG. 2.

In the first stage of the process used with preferred embodiment, an original 1 is illuminated by an illuminating device 2. Light from the original 1 is reflected by a movable mirror 3-2 the reflecting surface of which is directed towards the middle point between the original 1 and a projecting lens 4. The light thus reflected passes through the projecting lesn 4, directed downwardly by a mirror 5, directed horizontally by a mirror 6, and applied to the surface of a photosensitive drum 7 thus forming the image of the original on the surface of the photosensitive drum 7. In this operation, the original 1 is scanned in the direction of the arrow X. The original image is projected onto a semi-circumferential area A of the photosensitive drum 7 to form an electrostatic latent image thereon.

Upon rotation of the photosensitive drum 7 in the direction of the arrow, the electrostatic latent image is developed into a primary toner image by a developing device 14. The electrostatic latent image is maintained as it is until the second stage of the process is accomplished. The primary toner image is employed as a secondary original for forming the secondary toner image.

In the secondary stage of the process, with the photosensitive drum 7 turned through 180 degrees from its position where the primary toner image was formed thereon, the secondary original is scanned by turning the photosensitive drum. To accomplish this, the original image is illuminated by a second illumination device 10 disposed near the photosensitive drum 7. Light from the original image is reflected upwardly by a mirror 8 and is applied to the movable mirror 3-2 used in the second stage of the process. In the first stage of the process, the reflecting surface of the movable mirror 3-2 faces the original 1 and the projecting lens 4. However, in the second stage of the process, the reflecting surface of the movable mirror 3-2 faces the the mirror 3 and the projecting lens 4. Therefore, the light reflected from the movable mirror 3-2 passes through the projecting lens which was used for image formation. The light which has passed through the projecting lens is reflected by the mirrors 5 and 6, which have been used in the first stage of the process, as a result of which the primary toner image is projected onto the photosensitive drum 7 which has been turned through 180° as described before.

As this projection is carried out while the photosensitive drum 7 is being turned, the primary toner image which was formed on the area A of the photosensitive drum 7 is formed on the remaining semi-circumferential area B of the photosensitive drum 7. Since the area B has been charged by a charging device 13, the toner image thus formed is converted into an electrostatic latent image. The latent image is developed by a developing device 14 and is then transferred onto a copying sheet supplied from a copying sheet supplying device 16 by a transferring device 15. The copying sheet bearing the developed image is delivered to a fixing device 17 by a sheet delivering device 18 and the image is fixed by the fixing device 17. After the image has been transferred onto the copying sheet, the area B of the photosensitive drum 7 is discharged by a discharging device 11, remaining toner is removed by a cleaning device 12, and the area is charged again by the charging device 13. The above-described operations, i.e. the second stage of the process, are carried out repeatedly until a required number of copies have been obtained. In FIG. 2, reference numeral 19 designates a copy receiving unit.

As described above, in the second stage of the process the original image and the exposed image are on the same photosensitive drum so that synchronization is maintained at all times.

In accordance with the invention, unlike the conventional method in which transferring is carried out repeatedly using only one electrostatic latent image, the original is copied using the toner image as the secondary original. Therefore, the quality of the copied image is degraded very little. Thus, the method and apparatus of the invention are suitable for producing a large number of copies at a high rate.

In the second stage of the process, only the mirror 8 is additionally used so that the optical components used in the second stage of the process are substantially the same as those used in the first stage of the process which results in a reduction of the number of necessary components and a simplification of the assembly and adjusting processes needed during manufacture. Furthermore, the peripheral devices around the photosensitive drum such as the charging device, the developing device, the cleaning device and the toner supplying device can be used commonly for the first and second stages of the process. Therefore, as in the optical system, the manufacturing is greatly reduced compared with conventional devices. In addition, the copying apparatus according to the invention uses space quite economically so that the overall copying apparatus can be miniaturized.

Thus, the copying apparatus of the invention has a low manufacturing cost and small size, yet can produce a number of copies of high image quality in a short time.

What is claimed is:

1. A copying apparatus comprising: a single rotatable drum having first and second photosensitive surfaces provided thereon; and means for forming an image of an original on said first photosensitive surface and for forming an image of the image formed on said first photosensitive surface on said second photosensitive surface.

2. The copying apparatus of claim 1 wherein said image forming means comprises a single optical system used both to form said image of said original on said first photosensitive surface and for forming an image of said image formed on said first photosensitive surface on said second photosensitive surface.

3. The copying apparatus of claim 1 or 2 further comprising developing means for developing an electrostatic latent image formed on said first photosensitive surface into a primary toner image and for developing an electrostatic latent image formed on said second photosensitive surface into a secondary toner image; and means for transfering said secondary toner image to a recording sheet.

4. The copying apparatus of claim 2 wherein said optical system comprises a projecting lens, a plurality of fixed mirrors and a single movable mirror.

5. A copying apparatus comprising: a rotatable drum having first and second photosensitive surfaces provided thereon; an optical system comprising a movable mirror, a projecting lens and first through third mirrors, wherein for a first position of said movable mirror light is reflected from an original through said projecting lens and said first and second mirrors to a first side of said rotatable drum and in a second position of said movable mirror light is reflected from a second side of said drum by said third mirror to said movable mirror and through said projecting lens and said first and second mirrors to said first side of said rotatable drum.

6. The copying apparatus of claim 5 further comprising: means for illuminating an original; means for developing latent images formed on said first and second photosensitive surfaces into primary and secondary toner images, respectively; means for discharging said first and second photosensitive surfaces; means for cleaning toner from said first and second photosensitive surfaces; and means for transferring said secondary latent image from said second photosensitive surface onto a recording sheet.

7. A method for forming a plurality of copies using only a single scanning of an original, comprising the steps of: forming a latent image on a first photosensitive surface of a rotatable drum by scanning an original; developing said image formed on said first photosensitive surface of said rotatable drum to form a primary toner image; repeatedly transferring an image of said primary toner image on said first photosensitive surface onto said second photosensitive surface of said rotatable drum a number of times corresponding to the number of copies to be made; repeatedly developing the images formed on said second photosensitive surface to form secondary toner images; and transferring said secondary images from said second photosensitive surface onto recording sheets.

8. The method of claim 7 wherein a single optical system is utilized to form images of said original on said first photosensitive surface and to form images of said primary toner image on said second photosensitive surface.

9. The method of claim 8 wherein said optical system comprises a movable mirror and further comprising the step of positioning said movable mirror in a first position to direct an image of said original onto said first photosensitive surface and positioning said movable mirror to a second position to form images of said primary toner image onto said second photosensitive surface.

* * * * *